United States Patent [19]

Erickson et al.

[11] 3,977,810

[45] Aug. 31, 1976

[54] MULTIPLE OUTLET, CONSTANT FLOW, PITOT PUMP

[75] Inventors: John W. Erickson, Huntington Beach; Walter W. Crichlow, Santa Ana, both of Calif.

[73] Assignee: Kobe, Inc., Huntington Park, Calif.

[22] Filed: Sept. 23, 1974

[21] Appl. No.: 508,427

[52] U.S. Cl. ..... 415/89; 233/21

[51] Int. Cl.[2] ..... F04D 1/14

[58] Field of Search ..... 415/88, 89; 233/21

[56] References Cited

UNITED STATES PATENTS

| | | | |
|---|---|---|---|
| 3,671,136 | 6/1972 | O'Mara et al. | 415/89 |
| 3,791,757 | 2/1974 | Tarifa | 415/88 |

FOREIGN PATENTS OR APPLICATIONS

| | | | |
|---|---|---|---|
| 1,094,563 | 12/1954 | France | 415/89 |
| 684,207 | 11/1939 | Germany | 415/89 |
| 80,266 | 12/1955 | Netherlands | 415/89 |

*Primary Examiner*—Henry F. Raduazo
*Attorney, Agent, or Firm*—Christie, Parker & Hale

[57] ABSTRACT

A multiple outlet, constant flow pitot pump comprising: a rotary casing; means for delivering fluid to be pumped to the casing; a plurality of discharge ducts generally coaxial with the rotary casing; and a plurality of circumferentially spaced pitot tubes in and extending radially of the rotary casing, the pitot tubes respectively having adjacent their outer ends inlets facing in a direction opposite to the direction of rotation of the rotary casing, the pitot tubes respectively having radial passages and having adjacent their inner ends outlets respectively connecting the inner ends of such radial passages to the discharge ducts, the pitot tubes further respectively having circumferentially rearwardly extending passages connecting the inlets to the outer ends of the radial passages, the upstream ends of the circumferentially rearwardly extending passages having divergent portions diverging rearwardly from the inlets, and the ratio of the area of the inlet of each pitot tube to the area of the circumferentially rearwardly extending passage thereof at the rearward end of the divergent portion of such passage being in the range of 1:1.1 to 1:100, means being provided for adjusting such area ratio. With the foregoing construction, liquid fuel can be supplied to a plurality of burners, or other devices, from the respective pitot tubes at equal flow rates. Further, with the divergent inlet portions mentioned, each pitot tube can supply fluid at a constant flow rate over a wide pressure range, which pressure range could result from burner fuel nozzle plugging due to carbon deposits.

12 Claims, 7 Drawing Figures

800
700
600
500
400
300
200
100
0
PRESSURE – PSI
0
40
80
120
160
200
FLOW – GPM
1:4 AREA RATIO SHARP NOSE
1:2 AREA RATIO SHARP NOSE
1:2 AREA RATIO ROUNDED NOSE
1:1.5 AREA RATIO SHARP NOSE
1:1.5 AREA RATIO ROUNDED NOSE
1:1.1 AREA RATIO SHARP NOSE
STANDARD NOSE (1:1 AREA RATIO SHARP NOSE)

MULTIPLE OUTLET, CONSTANT FLOW, PITOT PUMP

BACKGROUND OF INVENTION

The present invention relates in general to centrifugal pumps and, more particularly, to a centrifugal pump of the pitot type, such a pump comprising, as its general elements, a rotary casing, means for delivering a fluid to be pumped to the rotary casing, a discharge duct coaxial with the rotary casing, and a pitot tube in the rotary casing for picking up fluid adjacent the periphery of the casing with a ram effect and for delivering the fluid to the discharge duct. More particularly, the pitot tube extends radially of the rotary casing and is provided adjacent its outer end with an inlet adjacent the periphery of the rotary casing and facing in a direction opposite to the direction of rotation of the rotary casing. The pitot tube is provided with a circumferentially rearwardly extending passage connecting the inlet to the outer end of a radial passage within the pitot tube, such radial passage having adjacent its inner end an outlet communicating with the discharge duct.

Such pitot pumps are well known, one typical of the prior art being disclosed in U.S. Pat. No. 3,776,658, issued Dec. 4, 1973 to John W. Erickson, one of the applicants herein.

More particularly, the present invention contemplates a pitot pump utilized as a liquid fuel pump, and it will be considered in such connection hereinafter as a matter of convenience in disclosing the invention. However, it will be understood that, in some instances, at least, the pitot pump of the invention may be utilized for pumping gaseous fuels, and again achieving constant flow independent of discharge pressure.

OBJECTS AND SUMMARY OF INVENTION

The primary object of the present invention is to provide a multiple outlet pitot pump which comprises a plurality of discharge ducts generally coaxial with the rotary casing, and a plurality of circumferentially spaced pitot tubes the outlets of which respectively communicate with the discharge ducts. The pitot tubes of such a pump may, for example, be utilized to deliver pressurized liquid fuel to corresponding burners independently of each other, thereby insuring equal fluid flow rates to the respective burners, which is an important feature of the invention. Such equal flow rates are difficult, if not impossible, to achieve with a single pump discharging into a manifold supplying a plurality of burners, or other devices, due to clogging of the fuel nozzles by carbon formation.

The number of pitot tubes may be varied, there being no intention of limiting the invention to the specific number, i.e., six, disclosed hereinafter. The pitot tubes may all be circumferentially aligned, or they may be axially staggered in various patterns to avoid having a particular pitot tube directly in the slipstream of the pitot tube ahead of it.

Another important object of the invention is to provide a construction wherein the upstream end of the circumferentially rearwardly extending passage of each pitot tube has a divergent portion diverging rearwardly from the inlet, the ratio of the area of the inlet of each pitot tube to the area of the circumferentially rearwardly extending passage thereof at the rearward end of the divergent portion of such passage being in the range of 1:1.1 to 1:100. With this construction, constant liquid fuel discharge rates are achieved throughout wide pressure ranges, which is another important feature of the invention.

The foregoing objects, advantages, features and results of the present invention, together with various other objects, advantages, features and results thereof which will be evident to those skilled in the pitot pump art, may be achieved with the exemplary embodiments of the invention illustrated in the accompanying drawings and described in detail hereinafter.

DESCRIPTION OF EXEMPLARY EMBODIMENTS OF INVENTION

Figure 1:
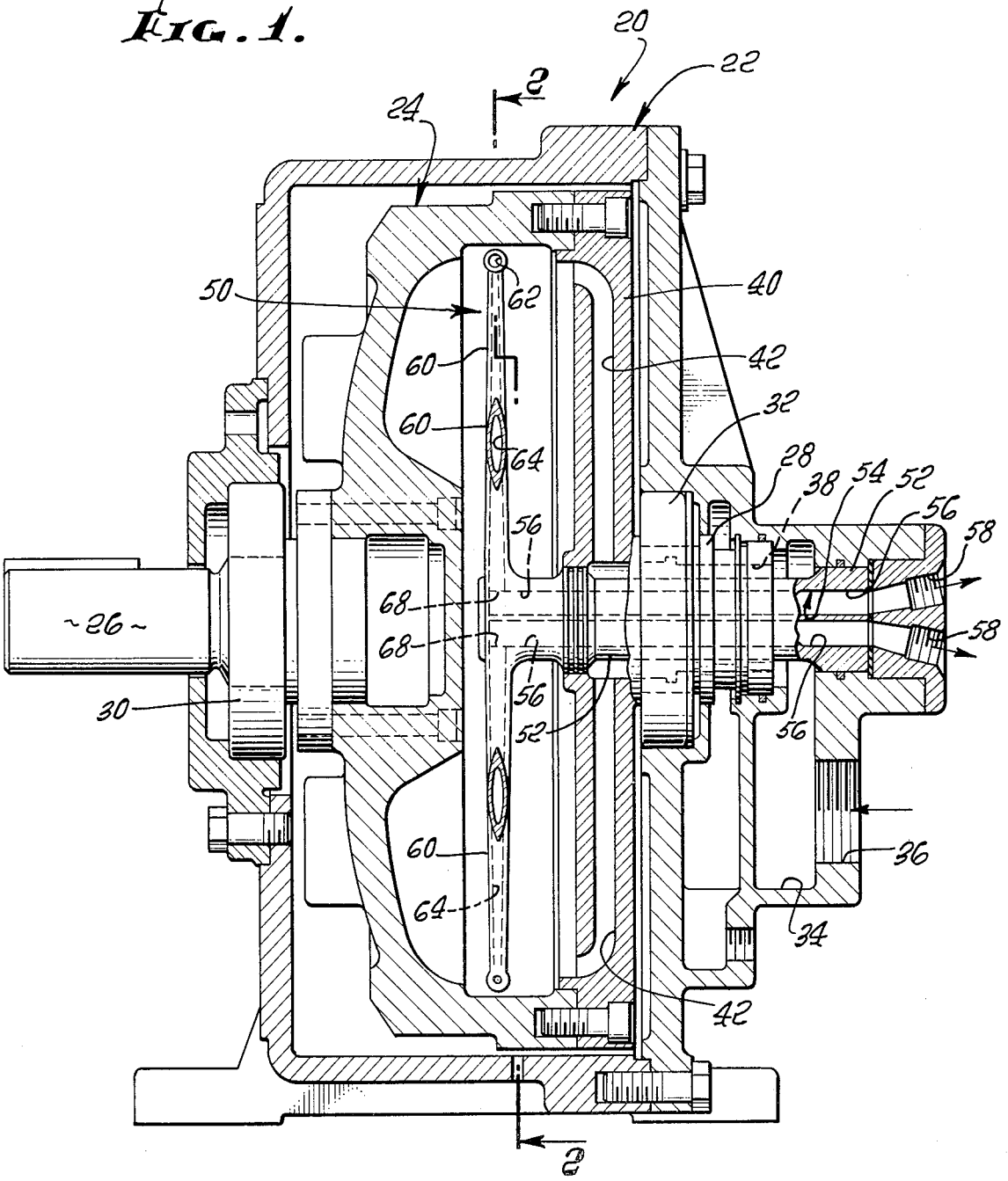
FIG. 1 is a longitudinal sectional view of a multiple outlet, constant flow, pitot pump which embodies the invention.
Figure 2:
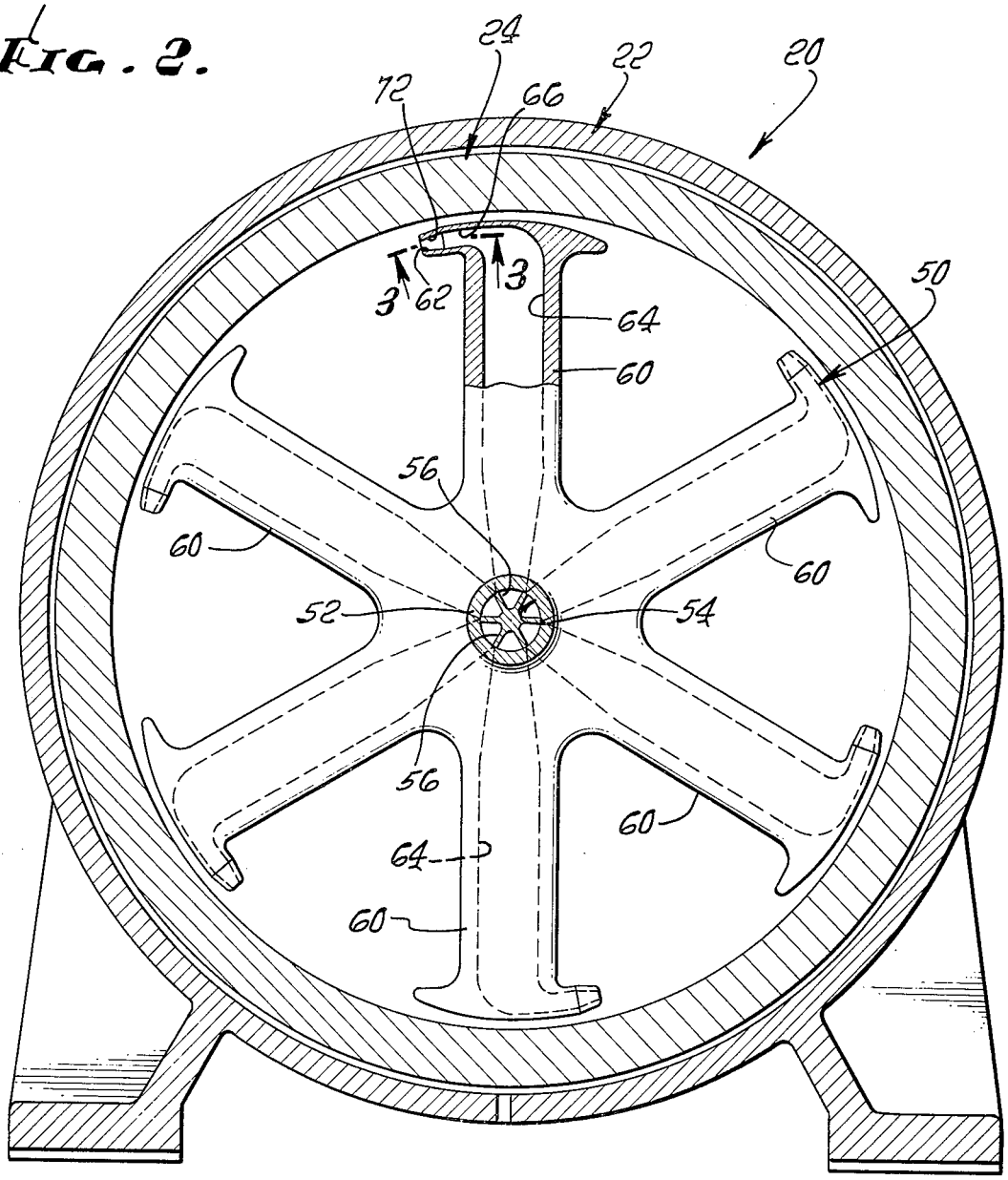
FIG. 2 is a transverse sectional view taken as indicated by the arrowed line 2—2 of FIG. 1.

Referring initially to FIGS. 1 and 2 of the drawings, illustrated therein is a pitot pump 20 comprising an outer housing 22 containing a rotary casing 24. In the particular construction illustrated, the rotary casing 24 is provided with coaxial shafts 26 and 28 carried by bearings 30 and 32 mounted in the housing 22. The shaft 28 is tubular. Also shown in FIG. 1 are suitable shaft seals which are unnecessary to describe. The rotary casing 24, in the particular construction illustrated, may be driven by any suitable means connected to the shaft 26.

The housing 22 is provided with an inlet 34, FIG. 1, for the liquid fuel, or other fluid, to be pumped, which inlet communicates with a chamber 36 leading to an annular passage 38 extending into one end wall 40 of the rotary casing 24. Within such end wall are circumferentially spaced, generally radial passages 42 which communicate at their inner ends with the annular passage 34 and which communicate at their outer ends with the interior of the rotary casing 24 adjacent the inner periphery thereof.

Within the rotary casing 24 is a pitot or pickup tube assembly 50 of the invention. This assembly, which is stationary, is carried by a tubular support 52 coaxial with the housing 22 and the rotary casing 24 and suitably secured to the housing. The tubular support 52 is provided with an axial outlet passage 54.

The axial outlet passage 54 is divided throughout its length into a plurality of discharge ducts 56 which terminate at their downstream ends in discharge ports 58. These discharge ports are respectively connected to fuel nozzles, or other devices, not shown, to which it is desired to deliver liquid fuel, or other fluids, at equal flow rates, as will be described.

The pitot tube assembly 50 includes a plurality of circumferentially spaced pitot tubes 60 in and extending radially of the rotary casing, such pitot tubes respectively having adjacent their outer ends inlets or noses 62 facing in a direction opposite to the direction of rotation of the rotary casing. The pitot tubes 60 respectively have radial passages 64 connected at their outer ends to the noses 62 by circumferentially rearwardly extending passages 66. The pitot tubes 60 are respectively provided at their inner ends with outlets 68 respectively connecting the radial passages 64 thereof to the discharge ducts 56.

The general mode of operation of the pitot pump 20 is well known so that it does not need to be described in detail. Briefly, the centrifugal force produced by the rotation of the casing 24 generates a high fluid pressure adjacent the inner periphery of the casing. The fluid at this high pressure enters the noses or inlets 62 of the pitot tubes 60, the pressure being further increased by the ram effect resulting from so orienting the inlets 62 that they face in a direction opposite to the direction of rotation of the rotary casing 24. The fluid entering the pitot tubes 60 is delivered to the respective discharge ports 58 through the passages 66, the passages 64, the outlets 68, and the discharge ducts 56. The flow rates of the fluid streams delivered to the respective discharge ports 58 are all equal since the pitot tubes 60 all have the same relationship to the rotary casing 24, and the other components of the pitot pump 20.

While the pitot pump 20 may be utilized for other purposes, it is ideally suited for use as a pitot pump to deliver liquid fuel at equal flow rates to fuel nozzles, not shown, respectively connected to the discharge ports 58. Such equal flow rates are difficult, if not impossible, to achieve with a single pump delivering liquid fuel to a manifold to which the individual nozzles are connected, due to differential nozzle clogging.

It will be understood that the number of pitot tubes 60 and corresponding discharge ports 58 may be varied, there being no intention of limiting the invention to the specific number, i.e., six, shown. Also, while the pitot tubes 60 are shown circumferentially spaced apart in the same transverse plane, it will be understood that they may be staggered axially of the pitot pump 20 so that no pitot tube operates in the slipstream or backwash of the pitot tube ahead of it. Alternatively, the six pitot tubes 60 shown may be divided into two groups with each group in a different transverse plane, the pitot tubes of each group being spaced apart by 120°. As still another alternative, the pitot tubes 60 may be divided into three axially spaced groups of two pitot tubes each, the pitot tubes of each group being spaced apart by 180°.

Turning to another aspect of the invention, the pitot tube inlets or noses 62 may be "conventional", i.e., of the type disclosed, for example, in the aforementioned Erickson U.S. Pat. No. 3,776,658. Such a nose will provide the pressure versus flow relationship indicated by the line in FIG. 5 labeled "STANDARD NOSE". As will be apparent, the STANDARD NOSE curve in FIG. 5 shows a considerable variation in flow rate with pressure. This is undesirable when utilizing the pump 20 as a pump for delivering liquid fuel to fuel nozzles, it being preferable to utilize constructions which will provide substantially constant liquid fuel flow rates throughout wide ranges of pressure, as indicated by the other six curves in FIG. 5. Such constant flow rates throughout wide pressure ranges may be achieved with the nose configurations shown in FIGS. 3 and 4 of the drawings (or shown in FIG. 6 thereof).

Figure 3:
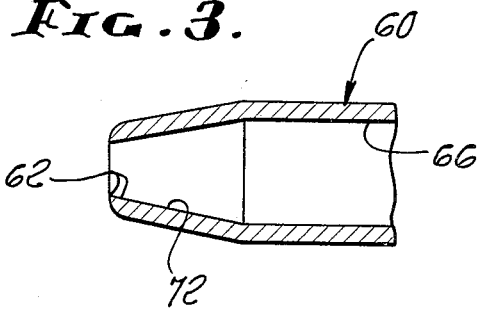
FIG. 3 is an enlarged, fragmentary sectional view showing the nose or inlet portion of a pitot tube of the invention and taken as indicated by the arrowed line 3—3 of FIG. 2.

More particularly, referring to FIG. 3, the upstream end of each rearwardly extending passage 66 has a divergent portion 72 diverging rearwardly from the corresponding inlet 62. In this case, the inlet or nose 62 is internally sharp, i.e., is provided with an internal circumferential edge which defines an acute angle. Preferably, the ratio of the area of the inlet or upstream end of the divergent portion 72 to the area of the outlet or downstream end of such divergent portion is in the range of 1:1.1 to 1:100. Correspondingly labeled curves in FIG. 5 show the flow versus pressure relationship for the sharp nose of FIG. 3 and for various area ratios ranging from 1:1.1 to 1:4.

Figure 4:
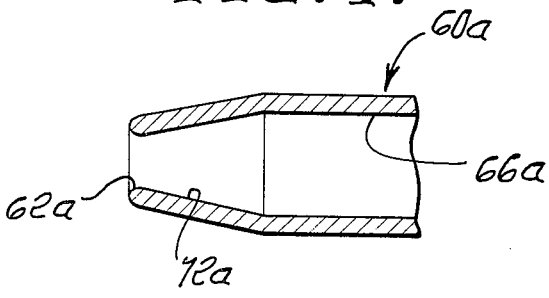
FIG. 4 is a view similar to FIG. 3, but showing an alternative embodiment.
Figure 5:
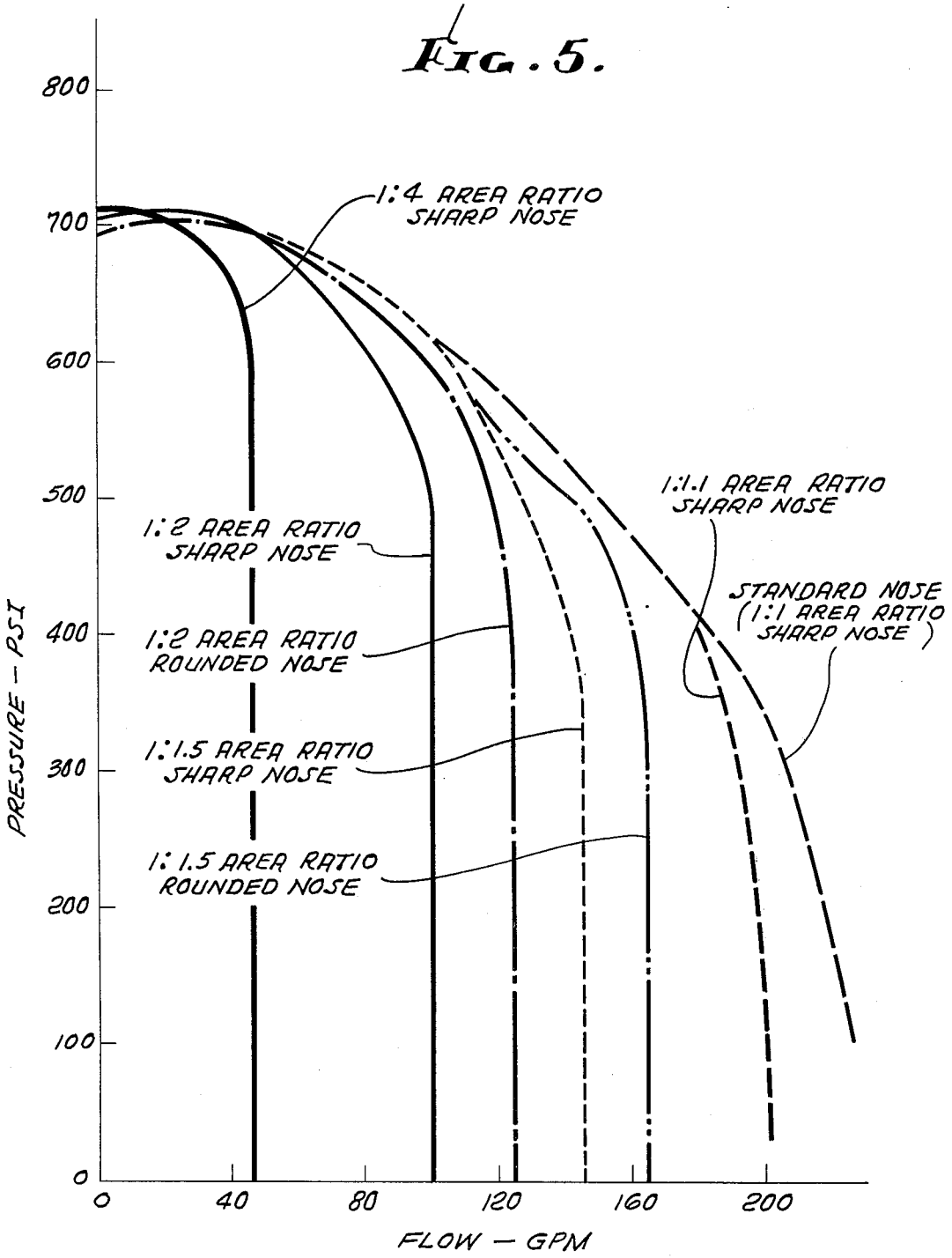
FIG. 5 is a graph of flow versus pressure for different pitot tube nose configurations.

Alternatively, FIG. 4 shows a pitot tube **60*a* having an inlet 62*a* and a rearwardly extending passage 66*a* the upstream end of which is provided with a rearwardly divergent portion 72*a*. In this case, the inlet or nose 62*a* is internally rounded, instead of being internally sharp. The internal rounding may take the configuration of a portion of an ellipse, for example. Correspondingly labeled curves in FIG. 5 show the flow versus pressure relationship for two different rounded noses 62*a*** respectively having divergence area ratios of 1:1.5 and 1:2. Ratios throughout the range of 1:1.1 to about 1:100 may be used with this configuration also.

It will be noted that all of the nose configurations and divergence ratios discussed provide constant flow rates from pressures just above zero to pressures of several hundred pounds per square inch, which is an important feature.

This same geometry of multihead pickup tubes with diffusor inlets also provides constant gas flow independent of compressor discharge pressure, when used on a pitot compressor.

Figures 6, 7:
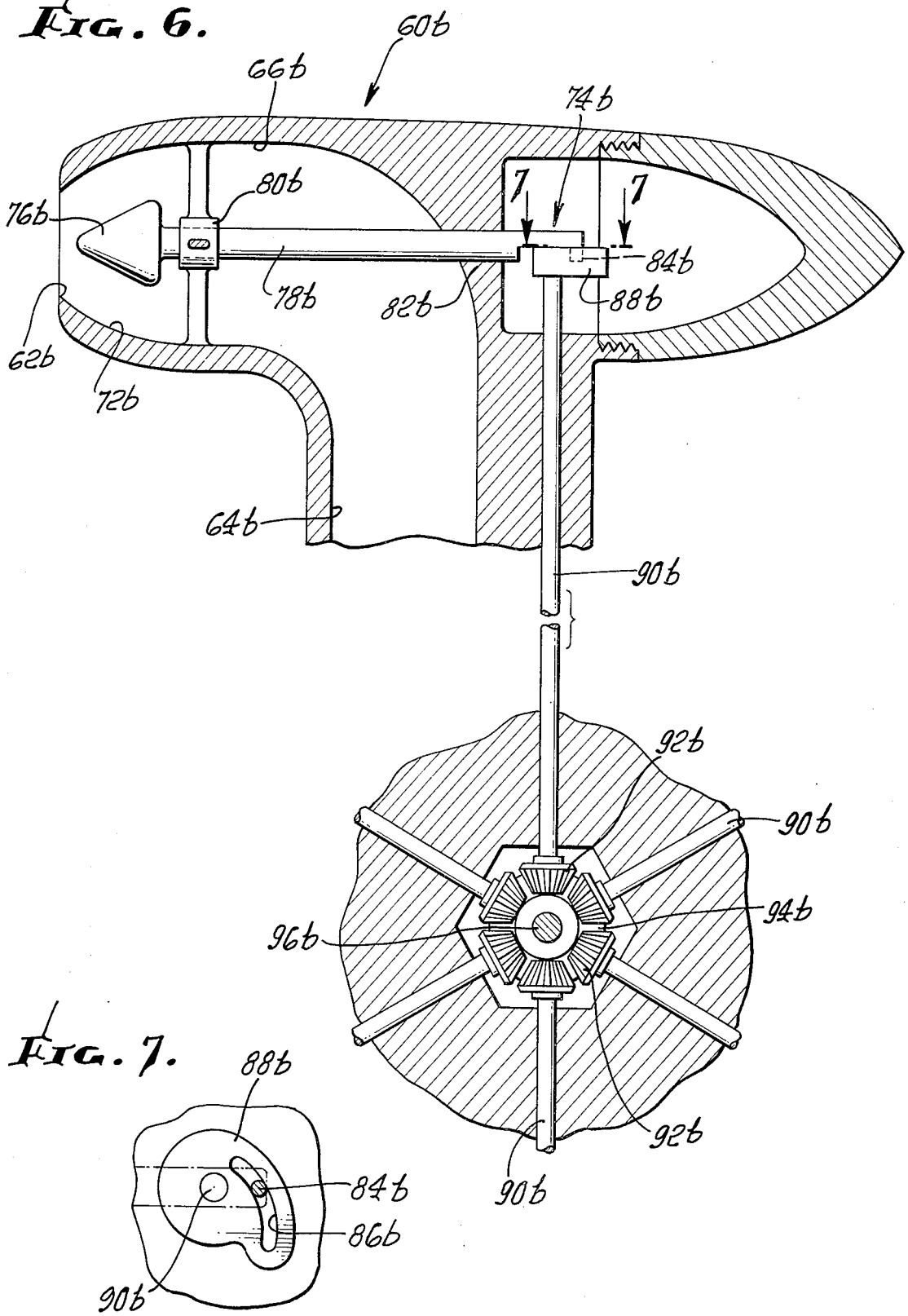
FIG. 6 is a semidiagrammatic transverse sectional view showing an adjustable pitot tube nose.
FIG. 7 is a view taken as indicated by the arrowed line 7—7 of FIG. 6.

Turning now to FIGS. 6 and 7 of the drawings, illustrated in FIG. 6 is a pitot tube **60*b* which is similar to the pitot tube 60 in that it includes a nose 62*b*, a rearwardly divergent portion 72*b*, a rearwardly extending passage 66*b*, and a radial passage 64*b*. This pitot tube 60*b* can be substituted for any or all of the pitot tubes 60**.

An important feature of the pitot tube **60*b* is that it is provided with means 74*b* for adjusting the hereinbefore-discussed divergence area ratio throughout the range of 1:1.1 to about 1:100. Thus, the pitot tube 60*b* can be adjusted to operate on any of the "SHARP NOSE" curves of FIG. 5**, or curves therebetween. (A similar construction can be provided with a rounded nose, not shown.)

More specifically, the divergence area ratio adjustment is achieved by varying the axial position of a generally cone-shaped member **76*b* relative to the inlet or nose 62*b*. As will be apparent from FIG. 6, by changing the axial position of the cone 76*b* relative to the nose 62*b*, the ratio of the area of the inlet of the pitot tube 60*b* to the area of the rearward end of the divergent portion 72*b*** can be varied.

To permit such axial adjustment of the position of the cone **76*b* within the rearwardly divergent portion 72*b*, the cone is carried by a rod 78*b* slidable in guides 80*b* and 82*b*. At the rearward end of the rod 78*b* is a cam follower 84*b*, shown simply as a pin, disposed in a variable-radius cam groove 86*b*, FIG. 7, in a cam 88*b*. The latter is carried by a radial shaft 90*b* rotatably mounted in the pitot tube 60*b* and provided at its inner end with a bevel gear 92*b*. The latter is meshed with a bevel gear 94*b* on an adjusting shaft 96*b* coaxial with the rotary casing 24 of the pitot pump 20. (In the event of a plurality of circumferentially spaced pitot tubes 60***b*, there are a plurality of the area ratio adjusting means 74*b*, as suggested by the additional bevel gears 92*b* and radial shafts 90*b*, shown in FIG. 6 of the drawings.)

As will be apparent, with the foregoing construction, the divergence area ratio of the pitot tube 60*b* can be adjusted readily by rotating the adjusting shaft 96*b*, thereby axially shifting the cone 76*b* through the intervening mechanism just described. Thus, the pitot tube 60*b* can be adjusted to operate on any of the corresponding curves of FIG. 5, or other curves in between, or outside the range shown, which is an important feature.

Although exemplary embodiments of the invention have been disclosed for illustrative purposes, it will be understood that various changes, modifications and substitutions may be incorporated in such embodiments without departing from the invention as hereinafter claimed.

We claim as our invention:

1. In a multiple outlet pitot pump, the combination of:

a. a rotary casing containing a pumping chamber;

b. feed means for delivering a fluid to be pumped to the pumping chamber in said rotary casing;

c. a plurality of discharge ducts generally coaxial with said rotary casing; and d. a plurality of pitot tubes in the pumping chamber and extending radially of said rotary casing, said pitot tubes respectively having adjacent their outer ends inlets facing in a direction opposite to the direction of rotation of said rotary casing, said pitot tubes respectively having radial passages and having adjacent their inner ends outlets respectively connecting the inner ends of said radial passages to said discharge ducts, and said pitot tubes further respectively having circumferentially rearwardly extending passages connecting said inlets to the outer ends of said radial passages, the area ratio of the rearwardly extending passage of each pitot tube relative to the inlet of the pitot tube being greater than 1.1 to 1.

2. A pitot pump according to claim 1 wherein said pitot tubes are circumferentially spaced and circumferentially aligned.

3. In a multiple outlet, constant flow pitot pump, the combination of:

a. a rotary casing containing a pumping chamber;

b. means for delivering a fluid to be pumped to the pumping chamber in said rotary casing;

c. a plurality of discharge ducts generally coaxial with said rotary casing; and d. a plurality of circumferentially spaced pitot tubes in the pumping chamber and extending radially of said rotary casing, said pitot tubes respectively having adjacent their outer ends inlets facing in a direction opposite to the direction of rotation of said rotary casing, said pitot tubes respectively having radial passages and having adjacent their inner ends outlets respectively connecting the inner ends of said radial passages to said discharge ducts, and said pitot tubes further respectively having circumferentially rearwardly extending passages connecting said inlets to the outer ends of said radial passages, the upstream ends of said circumferentially rearwardly extending passages having divergent portions diverging rearwardly from said inlets.

4. A pitot pump according to claim 3 wherein said pitot tubes are circumferentially aligned.

5. A pitot pump according to claim 3 wherein the ratio of the area of the inlet of each pitot tube to the area of the circumferentially rearwardly extending passage thereof at the rearward end of the divergent portion of such passage is in the range of 1 to 1.1, to 1 to 100.

6. In a multiple outlet, constant flow pitot pump the combination of:

a rotary casing;

means for delivering a fluid to be pumped to said rotary casing;

a plurality of discharge ducts generally coaxial with said rotary casing;

a plurality of circumferentially spaced pitot tubes in and extending radially of said rotary casing, said pitot tubes respectively having adjacent their outer ends inlets facing in a direction opposite to the direction of rotation of said rotary casing, said pitot tubes respectively having radial passages and having adjacent their inner ends outlets respectively connecting the inner ends of said radial passages to said discharge ducts, and said pitot tubes further respectively having circumferentially rearwardly extending passages connecting said inlets to the outer ends of said radial passages, the upstream ends of said circumferentially rearwardly extending passages having divergent portions diverging rearwardly from said inlets wherein the ratio of the area of the inlet of each pitot tube to the area of the circumferentially rearwardly extending passage thereof at the rearward end of the divergent portion of such passage is in the range of 1:1.1 to about 1:100; and means for varying said area ratio.

7. In a constant flow pitot pump, the combination of:

a rotary casing;

means for delivering a fluid to be pumped to said rotary casing;

a discharge duct at least generally coaxial with said rotary casing;

a pitot tube in and extending radially of said rotary casing, said pitot tube having adjacent its outer end an inlet facing in a direction opposite to the direction of rotation of said rotary casing, said pitot tube having a radial passage and having adjacent its inner end an outlet connecting the inner end of said radial passage to said discharge duct, and said pitot tube further having a circumferentially rearwardly extending passage connecting said inlet to the outer end of said radial passage, the upstream end of said circumferentially rearwardly extending passage having a divergent portion diverging rearwardly from said inlet wherein the ratio of the area of the inlet of said pitot tube to the area of the rearward end of said divergent portion is in the range of 1:1.1 to about 1:100; and means for varying said area ratio.

8. A pitot pump having controlled constant flow output comprising:

a rotary casing;

means for delivering a fluid to be pumped to the rotary casing;

a discharge duct for discharging pumped fluid;

a stationary pitot tube in the casing having an inlet facing generally circumferentially in a direction opposite to the direction of rotation of the rotary casing, an outlet connected to the discharge duct, and a passage between the inlet and the outlet, the passage including a portion diverging from the passage inlet; and means for varying the ratio of the area of the diverged portion of the passage to the area of the inlet portion of the passage in the range of from 1.1 to 1, to 100 to 1.

9. A pitot pump as recited in claim 8 wherein the means for varying comprises a cone coaxial with the inlet and means for moving the cone axially relative to the inlet.

10. A multiple outlet pitot pump comprising:

a rotary casing;

means for delivering a fluid to be pumped to the rotary casing;

a stationary outlet conduit coaxial with the rotary casing;

means for dividing the outlet conduit into a plurality of discharge ducts;

a plurality of stationary pitot tubes mounted on the outlet conduit in the rotary casing, each pitot tube being in fluid communication with one of the discharge ducts; and wherein each pitot tube includes a diverging passage portion adjacent the inlet of the pitot tube; and further comprising means for adjusting the ratio of the area of the divergent portion to the area of the inlet of each pitot tube.

11. A multiple outlet pitot pump as recited in claim 1 wherein the rotary casing is sealed so that fluid can enter the pumping chamber only from the feed means and fluid can leave the pumping chamber only via the pitot tubes.

12. In a multiple outlet pitot pump, the combination of:

a. a rotary casing containing a pumping chamber;

b. feed means for delivering a fluid to be pumped to the pumping chamber in said rotary casing;

c. a plurality of discharge ducts generally coaxial with said rotary casing, each of said discharge ducts being symmetrically arranged relative to the axis of rotation of the rotary casing and substantially identical to each other; and d. a plurality of pitot tubes in the pumping chamber and extending radially of said rotary casing, said pitot tubes respectively having adjacent their outer ends inlets facing in a direction opposite to the direction of rotation of said rotary casing, the inlets being at a common radius from the axis of rotation of the rotary casing, said pitot tubes respectively having radial passages and having adjacent their inner ends outlets respectively connecting the inner ends of said radial passages to said discharge ducts, and said pitot tubes further respectively having circumferentially rearwardly extending passages connecting said inlets to the outer ends of said radial passages.

* * * * *